US005572737A

United States Patent [19]

Valice

[11] Patent Number: 5,572,737

[45] Date of Patent: Nov. 12, 1996

[54] PADDED SKATING SHORTS

[76] Inventor: Steven F. Valice, 2126 Hollywood, Grosse Pointe Woods, Mich. 48236

[21] Appl. No.: 353,712

[22] Filed: Dec. 12, 1994

[51] Int. Cl.[6] ..... A41D 13/00

[52] U.S. Cl. ..... 2/465; 2/22; 2/238; 2/466; 2/904; 2/920

[58] Field of Search ..... 2/2, 22, 23, 227, 2/238, 275, 247

[56] References Cited

U.S. PATENT DOCUMENTS

| | | | |
|---|---|---|---|
| 1,669,085 | 8/1928 | Guyon | 2/23 |
| 4,325,148 | 4/1982 | Livernois | 2/22 X |
| 4,619,004 | 10/1986 | Won | 2/238 X |
| 4,700,407 | 10/1987 | Mattila . | |
| 4,803,109 | 2/1989 | Saniscalchi | 2/275 X |
| 4,872,211 | 10/1989 | Stone, III | 2/275 X |
| 4,894,867 | 1/1990 | Ceravolo et al. . | |
| 4,958,386 | 9/1990 | Louis-Jeune . | |
| 4,987,613 | 1/1991 | Loverdi et al. | 2/22 X |
| 5,303,424 | 4/1994 | Cromartie . | |

OTHER PUBLICATIONS

InLine Magazine, Advertisements from vol. 3 #1, Aug.–Sep. 1992; vol. 2 #2, Oct./Nov. 92; vol. 2, #1, Aug.–Sep. 1993; and vol. 3 #2, Oct./Nov. 1993.

Speed Skating Times, Advertisements from vol. 4, #6, Sep. 1, 1993 and vol. 5, #1, Dec. 1993.

*Primary Examiner*—Paul C. Lewis

*Attorney, Agent, or Firm*—Brooks & Kushman P.C.

[57] ABSTRACT

Two-piece padded skating shorts include a padded core shell and an outside shell releasably fastened to the padded core by first and second pairs of complementarily-formed fastening members at leg portions thereof. The padded core shell includes ball joint, thigh, hip, tail bone, kidney and buttocks pads, some of which include curved reinforced padding. The outside shell includes at least one pocket to store items therein. Waist portions of the core shell and the outside shell each include a belt sewn therein to secure the core shell and the outside shell to a wearer thereof.

19 Claims, 4 Drawing Sheets

PADDED SKATING SHORTS

TECHNICAL FIELD

This invention relates to padded skating shorts and, in particular, to two-piece padded skating shorts releasably fastened together.

BACKGROUND ART

In-line skating is becoming increasingly popular. As in-line skating becomes more and more popular, the need for clothing that is particularly tailored for this sport has also increased. Such clothing should allow a wide range of movement by the wearer and provide for adequate ventilation for use both indoors and outdoors.

Also, such clothing should provide proper protection for various parts of the wearer while at the same time provide a location(s) on the clothing in which the wearer can secure various objects such as keys, cards, and the like.

Safety

Over the past two years, the in-line community municipalities and other local governments have clashed over the language of specific ordinances and studies that apply to in-line skaters and their access to public forums. Local governments are concerned with the potential legal ramifications that may arise from permitting in-line skaters access to public premises, i.e., injuries or death related to activities on these designated areas. These ordinances and statutes are drafted in such broad language as to severely restrict and or prohibit the time, place and types of activities that may be conducted.

The In-Line Skating Federation, along with local in-line skating clubs, are attempting to head off the public perception that the sport is dangerous and that the number of injuries related to the sport are increasing due to a lack of experience in rollerblading techniques, recklessness and disregard for skater and pedestrian safety.

U.S. Pat. No. 4,700,407 to Mattila discloses protective shorts for sporting use having resilient, shock-absorbing pads formed in the basic material of the shorts. The pads also form part of the protective layer of the shorts. The pads can be manufactured of any suitable material and can be of any suitable shape. Furthermore, the pads can be positioned at any designated location on the shorts.

U.S. Pat. No. 4,894,867 to Ceravolo discloses a sports trunk that is both loose and flexible, and snug and form fitting. The sports trunk has open-ended leg portions and structure for tightening the open-ended leg portions, such as cooperating hook and pile surfaces. The sports trunk also has padding in the rump area to protect the buttocks against scraping and bruising.

U.S. Pat. No. 4,958,386 to Louis-Jeune discloses athletic leg wear on which one or more pocket assemblies are mounted between the knee and the waist of the wearer to hold one or more weights. The pockets may either be permanently attached or removably attached utilizing "Velcro (i.e. a nylon material made with both a surface of tiny hooks and a complementary surface of a clinging pile)."

U.S. Pat. No. 5,303,424 to Cromartie discloses a boxer-type swim suit for a water skier having a vent which extends across substantially the entire width of the rear portion of the swim suit. The vent allows first water and then air to escape which would otherwise be trapped below the waistband of a water skier's swim suit.

One of the problems associated with the prior art is that no one piece of clothing is capable of providing for all of the unique functions which are desired for such padded skating shorts.

SUMMARY OF THE INVENTION

An object of the present invention is to provide padded skating shorts having a padded core shell, an outside shell and a fastening mechanism for releasably fastening the outside shell to the core shell.

Another object of the present invention is to provide padded skating shorts having an outside shell, a core shell and a fastening mechanism for releasably fastening the outside shell to the core shell so that either one of or both of the outside shell and core shell may be cleaned, repaired, or otherwise serviced independent of the other shell, and wherein the core shell and/or the outside shell can be interchanged with other core shells and/or outside shells to customize the padded skating shorts depending on the particular aesthetic and/or functional needs of the wearer.

Another object of the invention is to provide a new and improved pair of athletic shorts to be worn by a person while engaged in in-line skating for recreational, speed racing, street hockey and which are safe, comfortable, flexible and durable.

It is another object of the present invention to provide new and improved athletic shorts which are easy to manufacture, can be mass produced and simple to wear.

In carrying out the above objects and other objects of the present invention, padded skating shorts are provided including a padded core shell including waist and leg portions. The shorts also include an outside shell adapted to be worn over the core shell to protect the core shell from damage and wear and tear. The outside shell also includes waist and leg portions. Finally, the shorts include a fastening mechanism secured to the core shell and the outside shell for releasably fastening the core shell to the outside shell when the outside shell is worn over the core shell.

Preferably, the fastening mechanism includes a first pair of fastening members secured to the leg portions of the outside shell and a second pair of complementarily-formed fastening members secured to the leg portions of the core shell wherein the first pair of fastening members are disposed in apposing relationship to the second pair of fastening members when the outside shell is worn over the core shell.

Resilient, shock absorbing pads are provided which are fitted in openings formed in the material and fastened stationarily flush with the basic material in such a manner that part of the layer protecting the person wearing the garment is formed solely by the pads.

Shock absorbing pads are advantageously positioned at desired parts of the body to obtain the best possible effect.

The protective inner core of the garment is comfortable in use.

The present invention is intended to afford greater protection for in-line skaters while providing the skater with a comfortable, flexible, durable and affordable product that does not inhibit his/her activities.

A further advantage is that the pads are absolutely reliably maintained in the right positions and at the right places relative to the wearer during skating activities.

The shorts are lightweight and are designed for comfort, flexibility, durability and protection.

The above objects and other objects, features, and advantages of the present invention are readily apparent from the following detailed description of the best mode for carrying out the invention when taken in connection with the accompanying drawings.

BEST MODES FOR CARRYING OUT THE INVENTION

Figure 1:
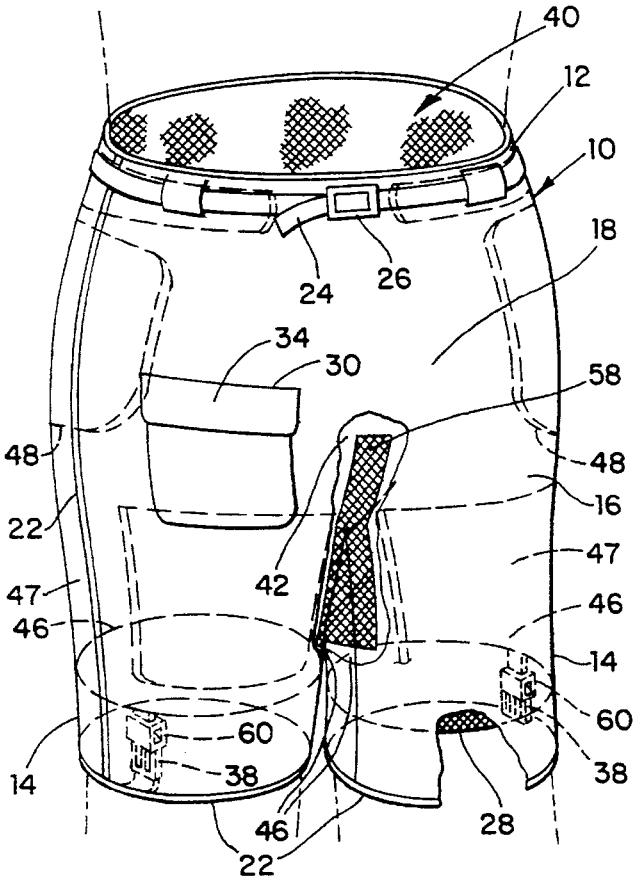
FIG. 1 is a partially broken-away front view of an outside shell constructed in accordance with the present invention with an inner core shell shown by phantom lines.
Figure 2:
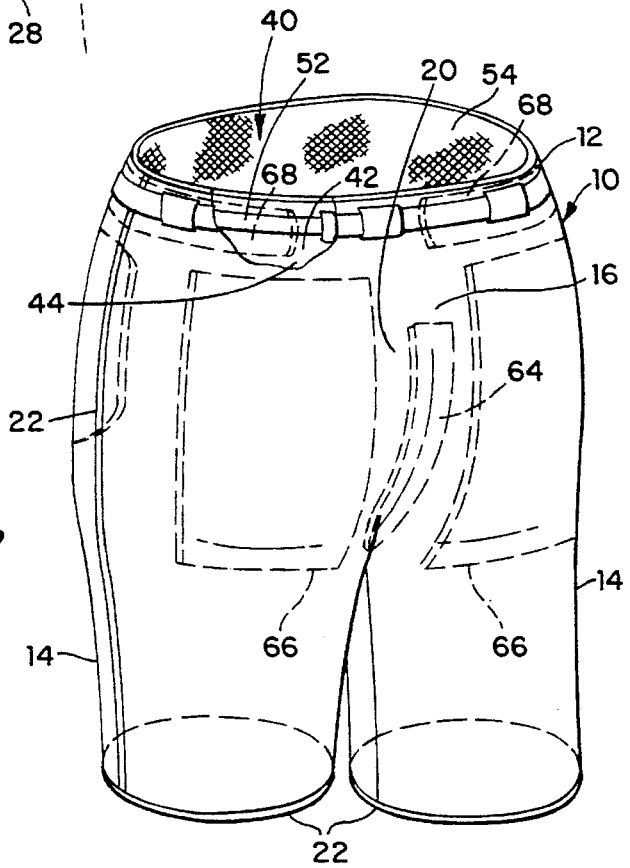
FIG. 2 is a partially broken-away back view of the outside shell with the core shell shown by phantom lines.
Figure 3:
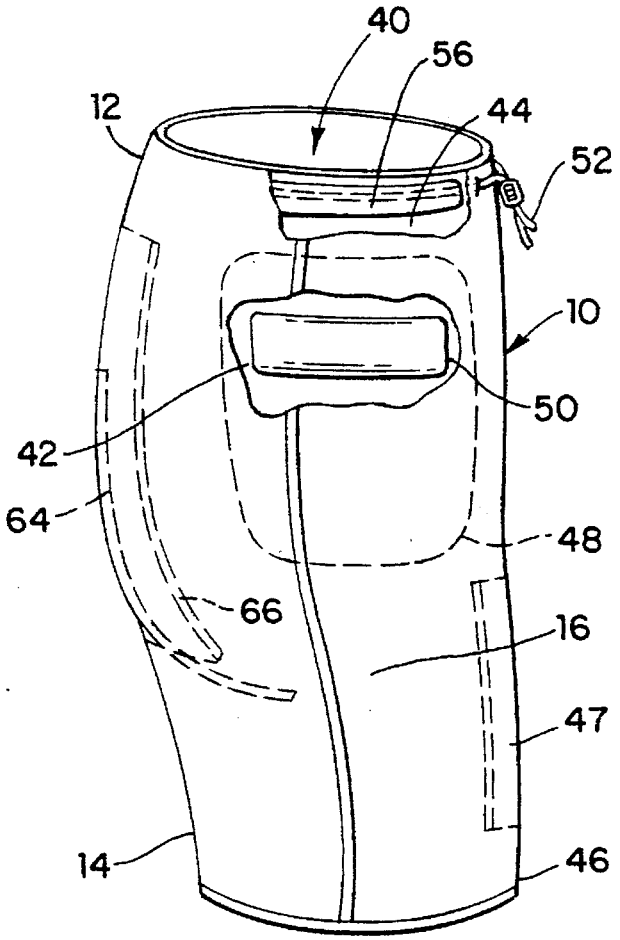
FIG. 3 is a partially broken-away side view of the outside shell with the core shell shown by phantom lines.

Referring now to the drawing figures, there is illustrated in FIGS. 1, 2 and 3 an outside shell, generally indicated at 10, constructed in accordance with the present invention. Preferably, the outside shell 10 includes waist and leg portions 12 and 14, respectively, and at least one pocket formed thereon. The outside shell 10 preferably includes an outer layer 16 of hydrophobic plastic-coated fabric or Nylon which also reduces wind penetration. The fabric is hydrophobic in that moisture is pulled to the outside of the fabric to dissipate and evaporate at an outer surface of the outer layer 16. Preferably, the fabric of the outer layer 16 is identified by the trademark entitled "GORTEX" (i.e., an insulating layer of material typically used with other layers of material and which passes moisture vapor therethrough).

The outer edges of front and back panels 18 and 20, respectively, of the outer layer 16 is reinforced by a tape seam 22 to fully seal the outside shell 10.

At the waist portion 12 of the outside shell 10, preferably, a webbing nylon belt 24 ensures maximum fastening to prevent the outside shell 10 from inadvertently falling off the wearer. Preferably, a plastic belt clip 26 secures the free ends of the nylon belt 24. The nylon belt 24 goes along the entire back of the waist portion 12 to ensure a secure fit around the waist of a wearer. Preferably, the belt 24 does not show from the back of the outside shell 10, but rather it is stitched into the waist portion 12.

Preferably, a mesh inner lining 28 is secured on the inside of the outer layer 16, such as by stitching, to enhance breathability and dispense moisture which may accumulate within the outside shell 10. The mesh inner lining 28 may be made from Capilene (i.e., a synthetic material which draws moisture away from the wearer) polyester or other material.

Preferably, the leg portions 14 of the outside shell 10 are slightly longer than baggy shorts and approximately three inches above the kneecap of the user or wearer.

Figure 4:
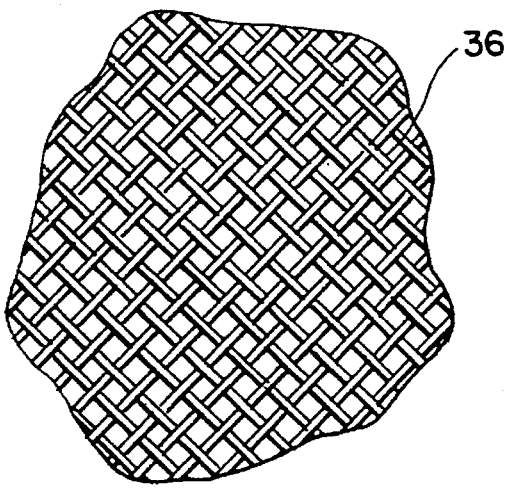
FIG. 4 is an enlarged, broken-away view of mesh strips of a pocket.

Also, preferably, the outside shell 10 has at least one pocket formed thereon to hold a variety of objects. For example, a relatively small pocket 30 may be provided for keys or loose change with a Velcro closure 34. On the front or side of the leg portions 14, larger pockets may be provided. Each of the larger pockets and/or the small pocket 30 may have a Velcro closure 34 or zipper, clasp or other closure. Preferably, the pocket 30 may be formed from mesh strips 36 as illustrated in FIG. 4 to allow water to drain therefrom.

A plastic buckle or fastening member 38 extends downwardly from an inner surface of each leg portion 14, and is secured thereto preferably by a stitched nylon webbing reinforcement 39. Each fastening member 38 forms a first part of a fastening means or mechanism for releasably fastening the outside shell 10 to a core shell, generally indicated at 40 in FIGS. 3 through 5, when the outside shell 10 is positioned over the core shell 40 which is described in greater detail hereinbelow.

Referring still to FIGS. 1–3, there is illustrated the padded core shell 40 by phantom lines. The core shell 40 includes an outer layer 42 having waist and leg portions 44 and 46, respectively, wherein the outer layer 42 has a plurality of pads secured thereto. Preferably, the outer layer 42 of the core shell 40 is made of a material referred to as 30-Denier rip stop nylon which is lightweight yet durable.

The core shell 40 has its seams reinforced to prevent tearing.

Preferably, the core shell 40 includes thigh pads 47 which extend beyond the end of the hip bone down to approximately 3½ inches from the knee cap. Stitching is reinforced around the pads 47.

Preferably, the core shell 40 includes lightweight polyester ball joint pads 48 interwoven with Technor Technora (i.e., aramid fibers manufactured by Teijin Co., Ltd.) or foam rubber on both sides of the buttocks which runs from approximately the top of the ball joint down to approximately 4½ inches from the kneecap. Preferably, each of the pads 48 has its stitching reinforced around the protective polyester.

On each pad 48, there is a ball joint reinforcement pad 50 which preferably comprises curved plastic molded to the shape of the ball joint area hip and leg connector socket. Preferably, the plastic pad 50 is encased in nylon, is double-seamed and is sewn into the lightweight polyester or foam rubber.

The waist portion 44 of the core shell 40 preferably includes a webbing nylon belt 52 which is built into the waist portion 44 and goes along the entire waist portion 44. The waist portion 44 includes two holes in the front as illustrated in FIG. 3 with a preferably Houdini-type draw cord which enables maximum tightness.

As with the outside shell 10, the core shell 40 also preferably includes a Capilene mesh lining 54 secured on the inside of the core shell 40 to allow moisture to pass from the wearer to the outside surface of the core shell 40.

Also provided is a hip joint reinforcement pad 56 similar to the ball joint reinforcement pad 50 to protect the hip joint of a user of the shorts. The hip joint reinforcement pad 56 is preferably comprised of body-shaped plastic-molded to shape around the hip area. This plastic is encased in nylon and is sewn into the lightweight polyester or foam rubber.

Referring specifically to FIG. 1, preferably nylon mesh approximately 3 inches in width defines a crotch portion 58 of the core shell 40 and allows moisture to be passed to the front surface of the core shell 40. The crotch portion 58 runs on top of the crotch along the inseam running to approximately 4 inches in back of the core shell 40. This allows for easier movement and a breathable material to absorb and dispense moisture.

Figure 5:
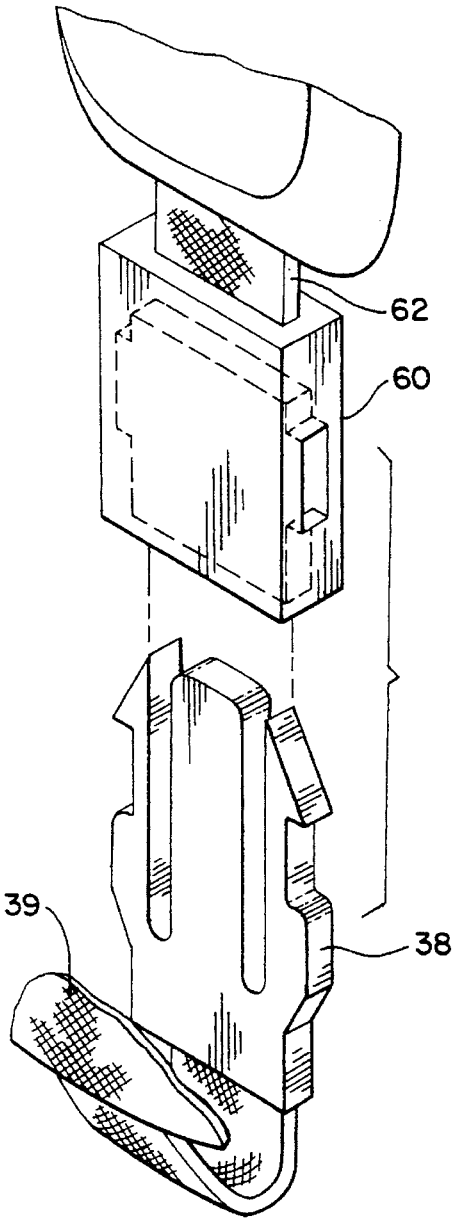
FIG. 5 is an enlarged, broken-away, perspective view of a first embodiment of a fastening mechanism of the present invention for releasably fastening the outside shell to the core shell.

The other part of the fastening mechanism comprises a plastic clasp holder 60 which is preferably attached with nylon webbing reinforcement 62 to the leg portions 46 of the core shell 40. When the holder 60 is secured to the buckle 38, as illustrated in FIG. 5, the fastening mechanism releasably fastens the core shell 40 to the outside shell 10 when the outside shell 10 is worn over the core shell 40.

As illustrated in FIGS. 2 and 3, the core shell 40 also includes a tailbone reinforcement pad 64 which is also preferably comprised of lightweight polyester and/or foam rubber. This padding is encased in nylon material. The tailbone reinforcement pad 64 runs from approximately 2 inches above the end of the tailbone section to approximately 2½ to 3 inches downwardly.

The core shell 40 also includes buttocks pads 66 preferably including lightweight polyester interwoven with Technor or foam rubber which runs just below reinforced kidney pads 68 to just below the end of the buttocks. Preferably, the pads 66 are also enclosed in nylon that is also double-seamed and sewn into the polyester or foam rubber of the outer layer of the core shell 40.

Preferably, the kidney reinforcement pads 68 include body-shaped, contoured plastic parts. The plastic parts are encased in nylon that is double-seamed and sewn into the lightweight polyester or foam rubber material of the outer layer of the core shell 40.

One or more of the pads noted above and below can be made from rubber, plastic, Technor, polyester, polymer/silicones or other materials.

Figure 8:
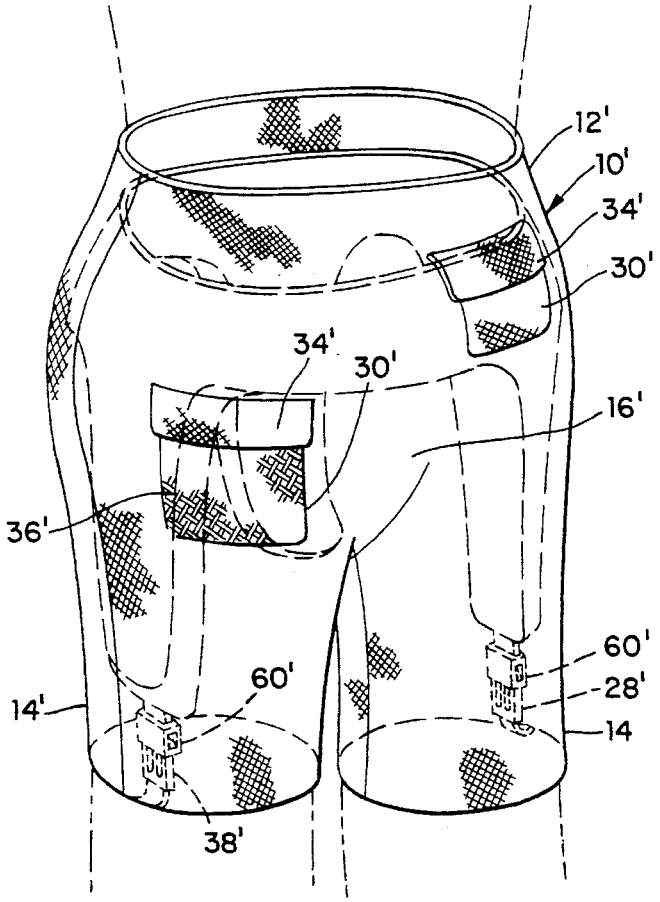
FIG. 8 is an environmental view of a second embodiment of padded skating shorts of the present invention with an outside shell indicated by solid lines and a core shell indicated by phantom lines.
Figure 9:
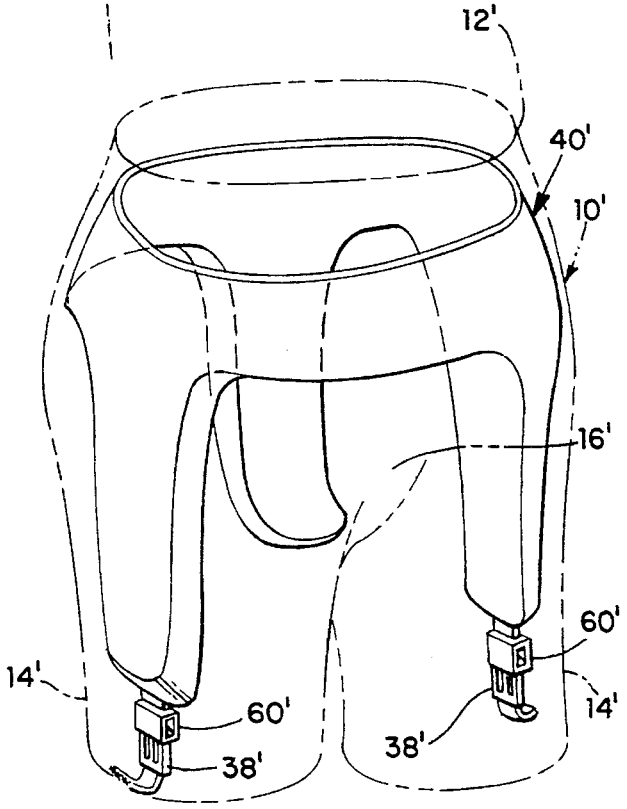
FIG. 9 is a view similar to FIG. 8 except the core shell is indicated by solid lines and the outside shell is indicated by phantom lines.

Referring now to FIGS. 8 and 9, there is illustrated a second embodiment of padded skating shorts including an outside shell 10' and a core shell 40' wherein parts which perform the same or similar function to the parts of the first embodiment have a prime designation. The core shell 40' and the outside shell 10' are releasably fastened together by a fastening mechanism such as the fastening mechanism previously described and illustrated in detail in FIG. 5.

The outside shell 10' includes at least one pocket 30' including one of which is preferably formed by mesh strips 36' and both of which are releasably secured by Velcro, zipper or clasp closures 34'.

Referring specifically to FIG. 9, the core shell 40' includes an integral padding to protect hip joints, ball joints, the kidneys, the thighs, the buttocks, and the tailbone of a wearer thereof.

Figure 6:
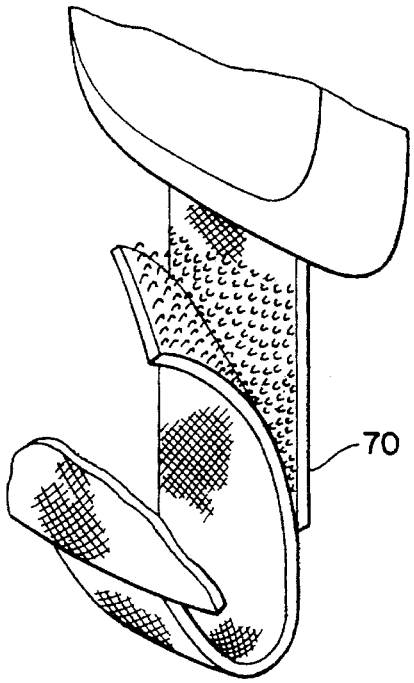
FIG. 6 is a view similar to FIG. 5 which illustrates a second embodiment of such a fastening mechanism.
Figure 7:
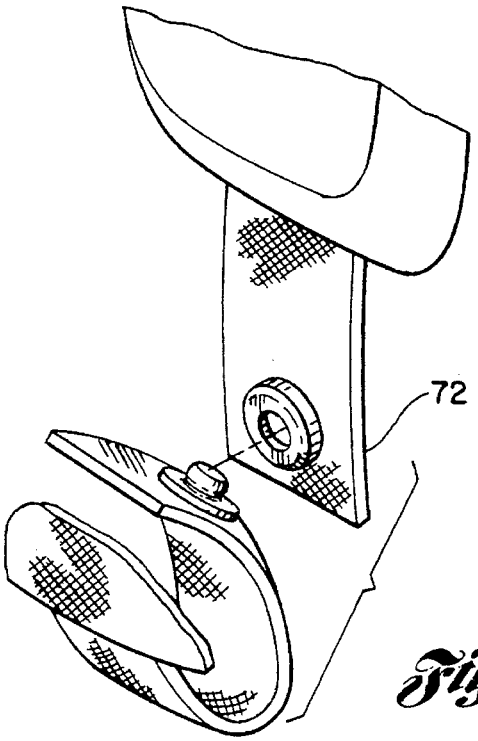
FIG. 7 is a view similar to FIG. 5 which illustrates a third embodiment of such a fastening mechanism.

Referring now to FIGS. 5–7, various fastening mechanisms are illustrated for releasably fastening the core shell 40 to the outside shell 10. As illustrated in FIG. 5, the fastening mechanism includes the buckle 38 and the holder 62.

In FIG. 6, the fastening mechanism comprises a Velcro system 70.

In FIG. 7, the fastening mechanism comprises a snap connection system 72.

While the best mode for carrying out the invention has been described in detail, those familiar with the art to which this invention relates will recognize various alternative designs and embodiments for practicing the invention as defined by the following claims.

What is claimed is:

1. Padded skating shorts comprising:

a padded core shell including waist and leg portions, the waist portion completely encircling a waist of a wearer when worn and each of the leg portions terminating in a lower extremity;

an outside shell adapted to be worn over the core shell to prevent the core shell from damage and wear and tear and also including waist and leg portions, the waist portion of the outside shell being adapted to completely encircle the waist of the wearer, and each of the leg portions of the outside shell also terminating in a lower extremity; and a fastening mechanism secured to the outside shell and the core shell for releasably fastening the core shell to the outside shell when the outside shell is worn over the core shell, wherein the fastening mechanism includes a first pair of fastening members secured to the lower extremities of the leg portions of the outside shell and a second pair of complementarily-formed fastening members secured to the lower extremities of the leg portions of the core shell wherein the first pair of fastening members are disposed in apposing relationship to the second pair of fastening members when the outside shell is worn over the core shell.

2. The shorts as claimed in claim 1 wherein the outside shell includes at least one pocket.

3. The shorts as claimed in claim 2 wherein the at least one pocket has mesh strips to allow water to drain from the at least one pocket.

4. The shorts as claimed in claim 1 wherein the outside shell includes an outer layer made from a fabric material.

5. The shorts as claimed in claim 4 wherein the outer layer of the outside shell includes front and back panels joined together about their periphery by a taped seam to seal the outer layer.

6. The shorts as claimed in claim 1 wherein the waist portion of the outside shell includes a belt sewn therein to secure the outside shell to a wearer thereof.

7. The shorts as claimed in claim 4 wherein the outer shell includes an inner layer secured to the outer layer of the outside shell.

8. The shorts as claimed in claim 7 wherein the inner layer of the outside shell is preferably a mesh-type inner layer.

9. The shorts as claimed in claim 1 wherein the core shell includes an outer layer and an inner layer secured to the outer layer of the core shell.

10. The shorts as claimed in claim 9 wherein the inner layer of the core shell is a fabric layer.

11. The shorts as claimed in claim 1 wherein the core shell includes a pair of curved, reinforced ball joint pads.

12. The shorts as claimed in claim 1 wherein the waist portion of the core shell includes a belt sewn therein to secure the core shell to a wearer thereof.

13. The shorts as claimed in claim 1 wherein the core shell includes a pair of thigh pads.

14. The shorts as claimed in claim 1 wherein the core shell includes a stretchable crotch portion interconnecting the leg portions of the core shell to permit greater range of movement to a wearer thereof.

15. The shorts as claimed in claim 1 wherein the core shell includes a pair of curved, reinforced hip pads.

16. The shorts as claimed in claim 1 wherein the core shell includes a reinforced tailbone pad.

17. The shorts as claimed in claim 1 wherein the core shell includes a pair of curved, reinforced kidney pads.

18. The shorts as claimed in claim 1 wherein the core shell including a pair of buttock pads.

19. Padded skating shorts comprising:

a padded core shell including waist and leg portions wherein the waist portion is adapted to completely encircle a waist of a wearer and each of the leg portions terminating in a lower extremity, wherein the core shell includes a belt sewn therein to secure the core shell to the wearer thereof;

an outside shell adapted to be worn over the core shell and also including waist and leg portions wherein the outside shell includes at least one pocket and wherein the waist portion of the outside shell is adapted to completely encircle the waist of the wearer and includes a belt sewn therein to secure the outside shell to the wearer thereof and wherein each of the leg portions of the outside shell also terminating in a lower extremity; and a first pair of fastening members secured to the lower extremities of the leg portions of the outside shell and a second pair of complementarily-formed fastening members secured to the lower extremities of the leg portions of the core shell wherein the first pair of fastening members are disposed in apposing relationship to the second pair of fastening members to releasably fasten the core shell to the outside shell when the outside shell is worn over the core shell.

* * * * *